US007474266B2

(12) United States Patent
Lee

(10) Patent No.: US 7,474,266 B2
(45) Date of Patent: Jan. 6, 2009

(54) METAL INVERTED F ANTENNA

(75) Inventor: Chang-Jung Lee, Longtan Township, Taoyuan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/437,737

(22) Filed: May 22, 2006

(65) Prior Publication Data

US 2007/0268184 A1 Nov. 22, 2007

(51) Int. Cl.
*H01Q 1/38* (2006.01)

(52) U.S. Cl. ..... 343/700 MS; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 6,222,496 | B1 * | 4/2001 | Liu | 343/846 |
| 6,781,547 | B2 * | 8/2004 | Lee | 343/700 MS |
| 6,930,641 | B2 * | 8/2005 | Ohara et al. | 343/702 |
| 6,950,068 | B2 * | 9/2005 | Bordi et al. | 343/702 |
| 2006/0033665 | A1 * | 2/2006 | Yang | 343/700 MS |

* cited by examiner

*Primary Examiner*—Tan Ho
(74) *Attorney, Agent, or Firm*—Birch, Stewart, Kolasch & Birch, LLP

(57) ABSTRACT

The present invention discloses an antenna structure comprising a ground plane; a radiator having a curved shape portion and a rectangular portion connected to the ground plane via a first end of the curved shape portion and grounded by a ground point of the ground plane, the rectangular portion being connected to a second end of the curved shape portion; and a feed point connected to the second end of the curved shape portion of the radiator.

10 Claims, 5 Drawing Sheets

METAL INVERTED F ANTENNA

BACKGROUND OF THE INVENTION

Brief Discussion of Related Art

As telecommunication technologies advance from wired to wireless communication driven by efficiency and convenience for the general public in the past decade, wireless communication devices and their implementation have become ubiquitous. Antennas have been a key building block in the construction of every wireless communication system. In many instances, the antenna is not considered critical in the initial system design. However, the antenna is the single device that allows RF energy to transition between wired transmission lines and free space. Consequently, antennas and propagation are the key factors influencing the robustness and quality of the wireless communication channel.

Typically, conventional helical antennas or linear monopole antennas are used as antennas for potable terminals. The helical antennas or linear monopole antennas have a merit of omni-directional radiation characteristic, since they are of external type projecting outside the device, therefore, they are likely to be damage by an external force.

One planar antenna called planar inverted F antenna (PIFA) having a low profile structure is employed as an internal antenna configured inside a mobile communication terminal. The conventional PIFA includes a radiating element, a coaxial wire and a ground plane. The radiating element is fed through the coaxial wire, and is connected to the ground plane so that an impedance match can be achieved. The conventional PIFA must be designed by taking into account the length L of the radiating element and the height of the antenna according to the width of the radiating element. The PIFA functions as a square-shaped micro-strip antenna with the length of the radiating unit reduced to half, achieving a low profile structure. Further the PIFA is an internal antenna installed in the mobile communication terminal, thereby being aesthetically designed and protected from external impact.

Since the miniaturization method used in the conventional antenna is based on a two-dimensional structure, there is a limit to the miniaturization. The space for the antenna in the portable device is reduced day by day, there is a keen need of improvement for the miniaturization. There is still a need of improvement in view of a space use or a feeding efficiency.

However, wireless communication is characterized by limited available frequency spectrum, low transmission powers and limited device processing capability.

SUMMARY OF THE INVENTION

One object of the present invention is to provide a plane antenna.

Another object of the present invention is to provide an F-shape antenna.

Still another object of the present invention is to provide an antenna structure radiator having a curved shape portion and a rectangular portion connected to the ground plane such as to improve the performance of the antenna.

The present invention discloses an antenna structure comprising a ground plane; a radiator having a curved shape portion and a rectangular portion connected to the ground plane via a first end of the curved shape portion and grounded by a ground point of the ground plane, the rectangular portion being connected to a second end of the curved shape portion; and a feed point connected to the second end of the curved shape portion of the radiator. The rectangular portion of the radiator is parallel to the ground plane.

The thickness of the above antenna structure is from 0.3 millimeter to 2 millimeter. The length of the rectangular portion of the radiator is about ¼ wavelength. The width of the rectangular portion of the radiator is from 1/20 to 1/50 wavelength. The radius of the outermost circle of the curved shape portion of the radiator is about 1/16 wavelength. The radius of the center hollow circle of the curved shape portion of the radiator is about 1/16 wavelength subtracting the width of the rectangular portion of the radiator.

The height of the above antenna structure is greater than or equal to the sum of the width of the rectangular portion of the radiator and the radius of the center hollow circle of the curved shape portion of the radiator. The length from the open end of the rectangular portion to the center of the curved shape portion of the radiator is greater than the sum of the length of the rectangular portion and the radius of the center hollow circle of the curved shape portion of the radiator. The total length of the above antenna structure is greater than the sum of the length of the rectangular portion and the radius of the outermost circle of the curved shape portion of the radiator.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The aforementioned objects, features, and advantages will become apparent from the following detailed description of a preferred embodiment taken together with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF A PREFERRED EMBODIMENT

Figure 1:
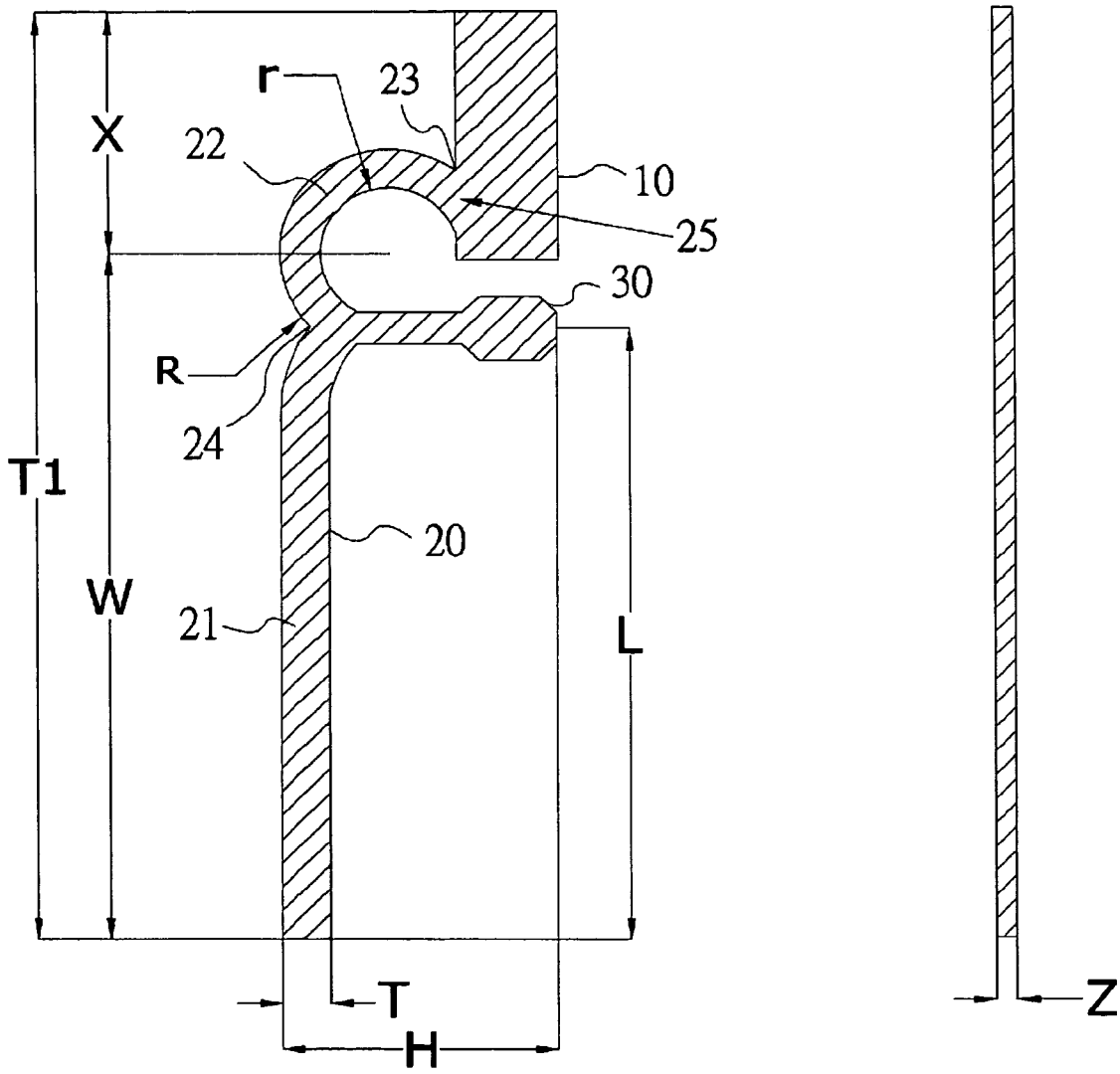
FIG. 1 is a schematic diagram of the planar metal inverted F antenna of the present invention.

The preferred embodiments of the present invention will be described in detail with reference to the annexed drawings. In the drawings, the same or similar elements are denoted by the same reference numerals even though they are depicted in different drawings. In the following description, a detailed description of known functions and configurations incorporated herein will be omitted when it may make the subject matter of the present invention rather unclear.

FIG. 1 is a perspective view of a state where antennas of the present invention are combined to a ground metal plane. As shown in FIG. 1, a radiation element of the antenna is combined to one of edges of a ground metal plane 10. The basic properties that are used to describe the performance of an antenna include impedance, voltage standing wave ratio (VSWR) or standing wave ratio (SWR), amplitude radiation patterns, directivity, gain, polarization and bandwidth.

In order to achieve maximum power transfer between a wire or coaxial transmission line and an antenna, the input impedance of the antenna must identically match the characteristic impedance of the transmission line. The ratio between the maximum voltage and the minimum voltage along the transmission line is defined as the VSWR. The VSWR, which can be derived from the level of reflected and forward waves, is also an indication of how closely or efficiently an antenna's terminal input impedance is matched to the characterized impedance of the transmission line. An increase in VSWR indicates an increase in the mismatch between the antenna and the transmission line.

Referring to FIG. 1, it shows a schematic diagram of the planar metal inverted F antenna of the present invention. The antenna structure comprises a ground plane 10. A radiator 20 having a curved shape portion 22 and a rectangular portion 21 is connected to the ground plane 10 via a first end 23 of the curved shape portion 22 and grounded by a ground point 25 of the ground plane 10. The ground point 25 constituting a grounding line is located substantially at the edge of the radiator 20. The feed point 30 can be implemented as coaxial feed. The feed point can also be implemented by placing it at the edge of the radiator 20. In one embodiment, the radiator 20 includes the curved shape portion 22 and the rectangular portion 21. The feed point 30 is connected to a second end 24 of the curved shape portion 22. The rectangular portion 21 of the radiator 20 is parallel to the ground plane 10.

The planar radiator is provided with a groove at the interface between the curved shape portion and the rectangular portion. Such a plane antenna structure is suitable for use in more than one frequency range. An open end of the rectangular portion 21 resides at the edge of the rectangular portion 21 of the radiator 20. An open end of the ground plane 10 resides at the edge of the plane.

In order for the plane antenna to operate as desired, the curved shape portion 22 is placed in the radiator 20 between the ground point 25 and the feed point 30. The rectangular portion 21 is projecting from the second end 24 of the curved shape portion 22.

Furthermore, as the curved and rectangular radiating elements 21, 22 are connected to the common the ground element, a compact internal antenna can be manufactured. Preferably, the feeding element 30 is arranged vertically to the radiator 20. However, when a ground condition based on the structure of the terminal equipped with the internal antenna is varied, some physical parameters between the feeding element, radiator and the ground can be varied so that the radiating element radiates the polarized waves of a predetermined band frequency, respectively. Furthermore, the radiating element can be a wire or planar radiating element, and can be variously modified.

The thickness of the above antenna structure is from 0.3 millimeter to 2 millimeter. The length of the rectangular portion 21 of the radiator 20 is about ¼ wavelength. Quarter wave means that the antenna length is ¼ of the wavelength of the operation frequency at which it its resonant. The width of the rectangular portion 21 of the radiator 20 is from 1/20 to 1/50 wavelength. The radius of the outermost circle of the curved shape portion 22 of the radiator 20 is about 1/16 wavelength. The radius of the center hollow circle of the curved shape portion 22 of the radiator 20 is about 1/16 wavelength subtracting the width of the rectangular portion 21 of the radiator 20. It shall be appreciated that the specific embodiment of the invention has been described herein for purposes of illustration rather than limiting the invention.

The height of the above antenna structure is greater than or equal to the sum of the width of the rectangular portion 21 of the radiator 20 and the radius of the center hollow circle of the curved shape portion 22 of the radiator 20. The length from the open end of the rectangular portion 21 to the center of the curved shape portion 22 of the radiator 20 is greater than the sum of the length of the rectangular portion 21 and the radius of the center hollow circle of the curved shape portion 22 of the radiator 20. The total length of the above antenna structure is greater than the sum of the length of the rectangular portion 21 and the radius of the outermost circle of the curved shape portion 22 of the radiator 20.

Figure 2:
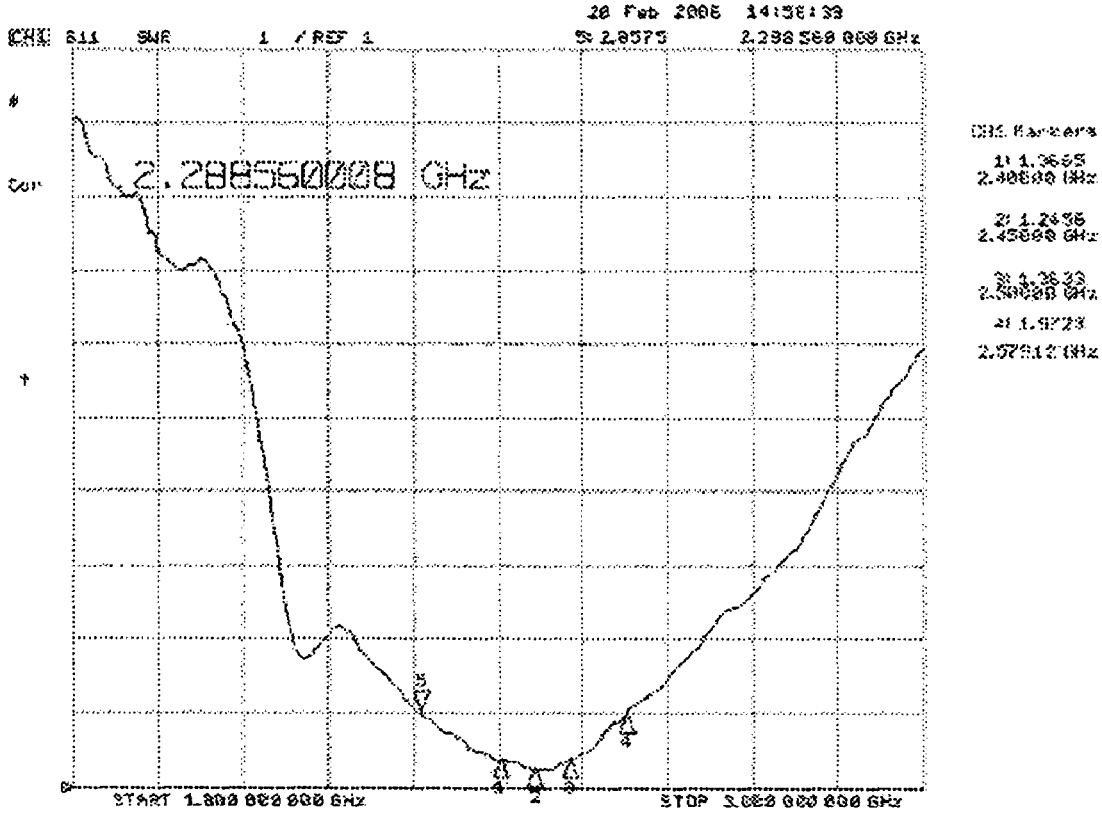
FIG. 2 is the SWR according to the present invention.

FIG. 2 shows the SWR illustration of the antenna. One of the basic properties to indicate the performance of an antenna includes the standing wave ratio (SWR). The SWR can be derived from the level of reflected and forward waves, is also an indication of how closely or efficiently an antenna's terminal input impedance is matched to the characterized impedance of the transmission line. From point 4 and 5 of the figure, the corresponding frequencies are respectively 2.57912 GHz and 2.288560 GHz. Thus, the bandwidth of the antenna is almost wider than 300 MHz. The performance of the antenna is pretty good.

Figure 3:
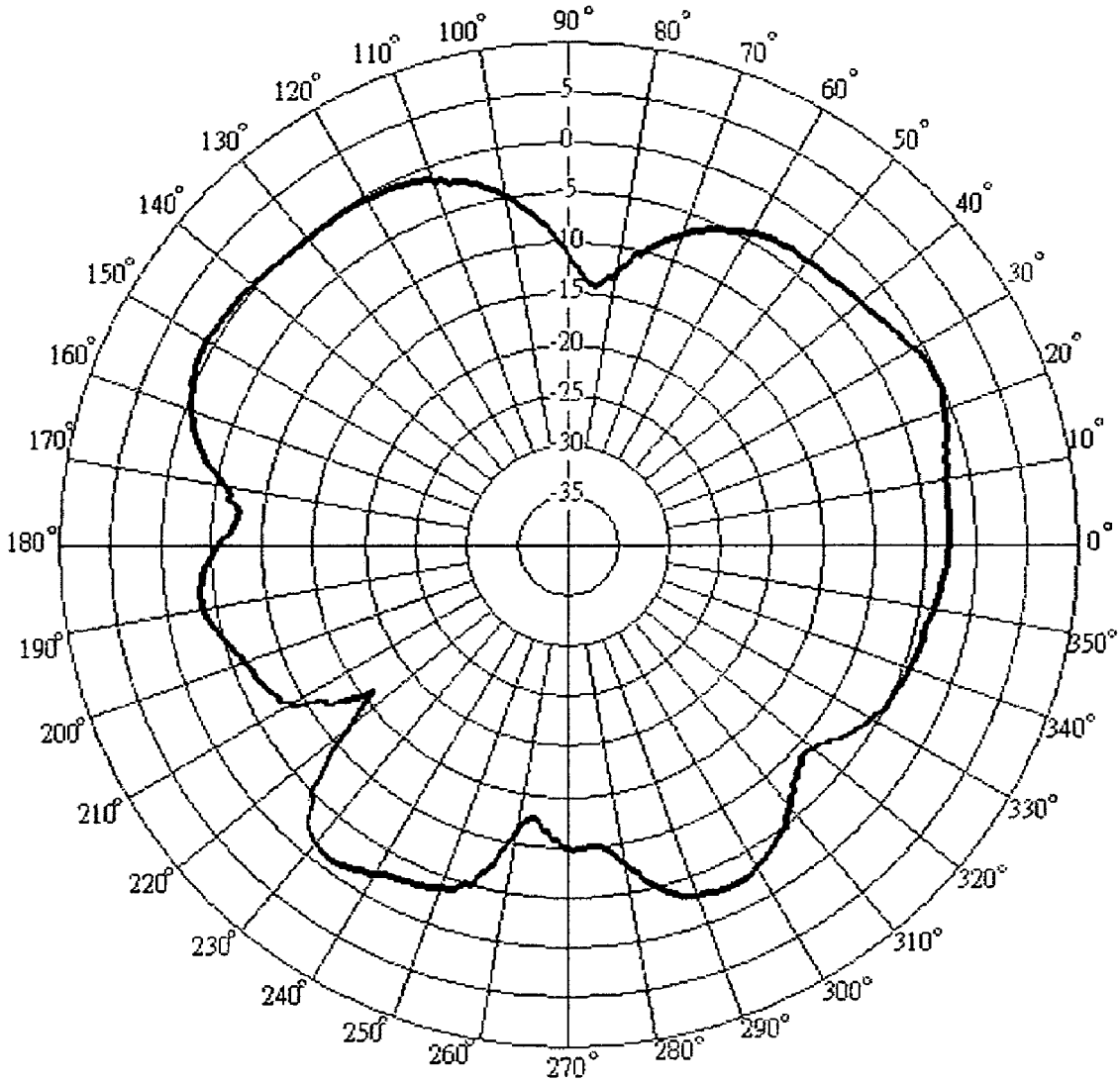
FIG. 3 is the radiation pattern in a resonant frequency of 2.4 GHz according to the present invention.
Figure 4:
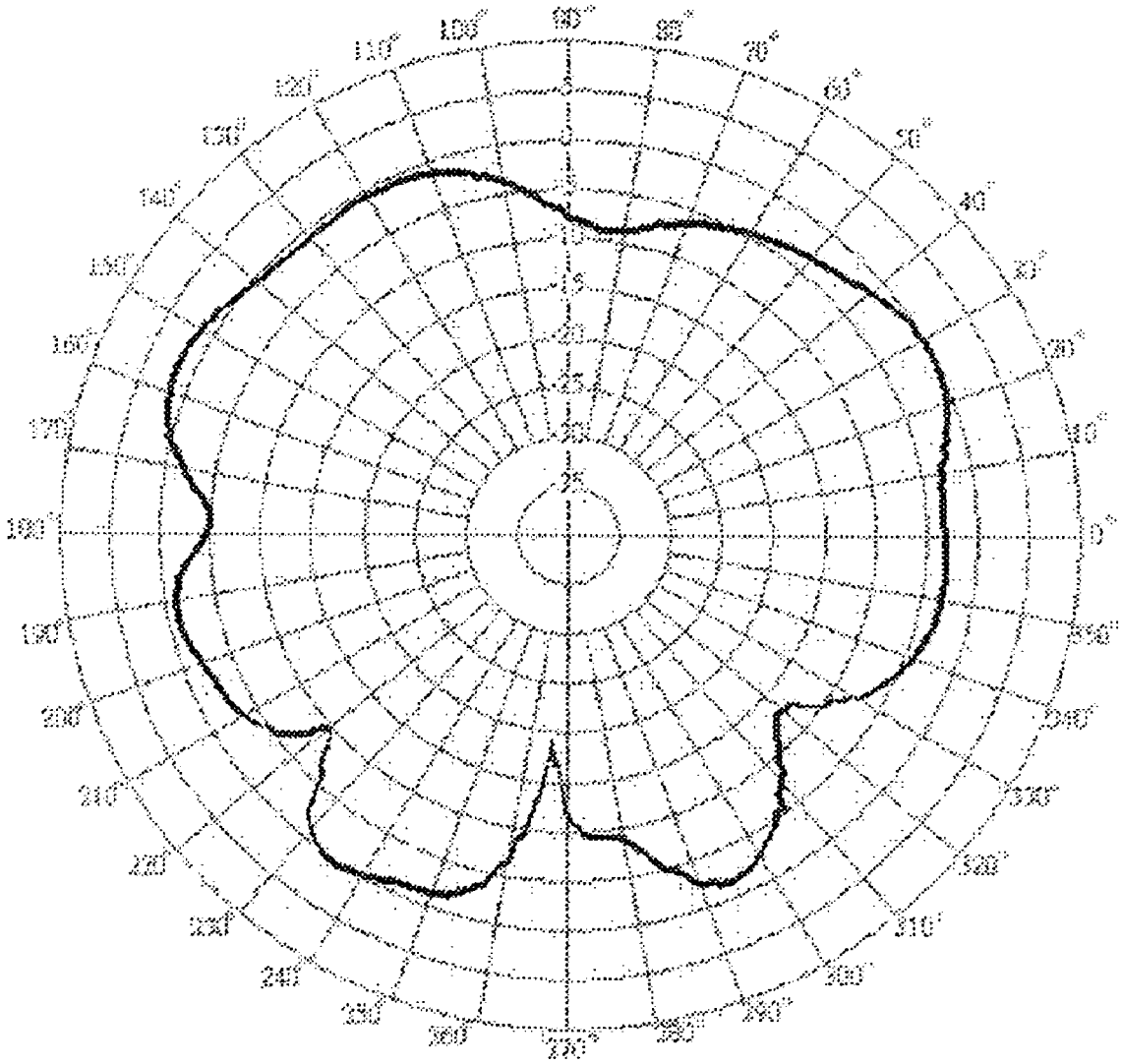
FIG. 4 is the radiation pattern in a resonant frequency of 2.45 GHz according to the present invention.
Figure 5:
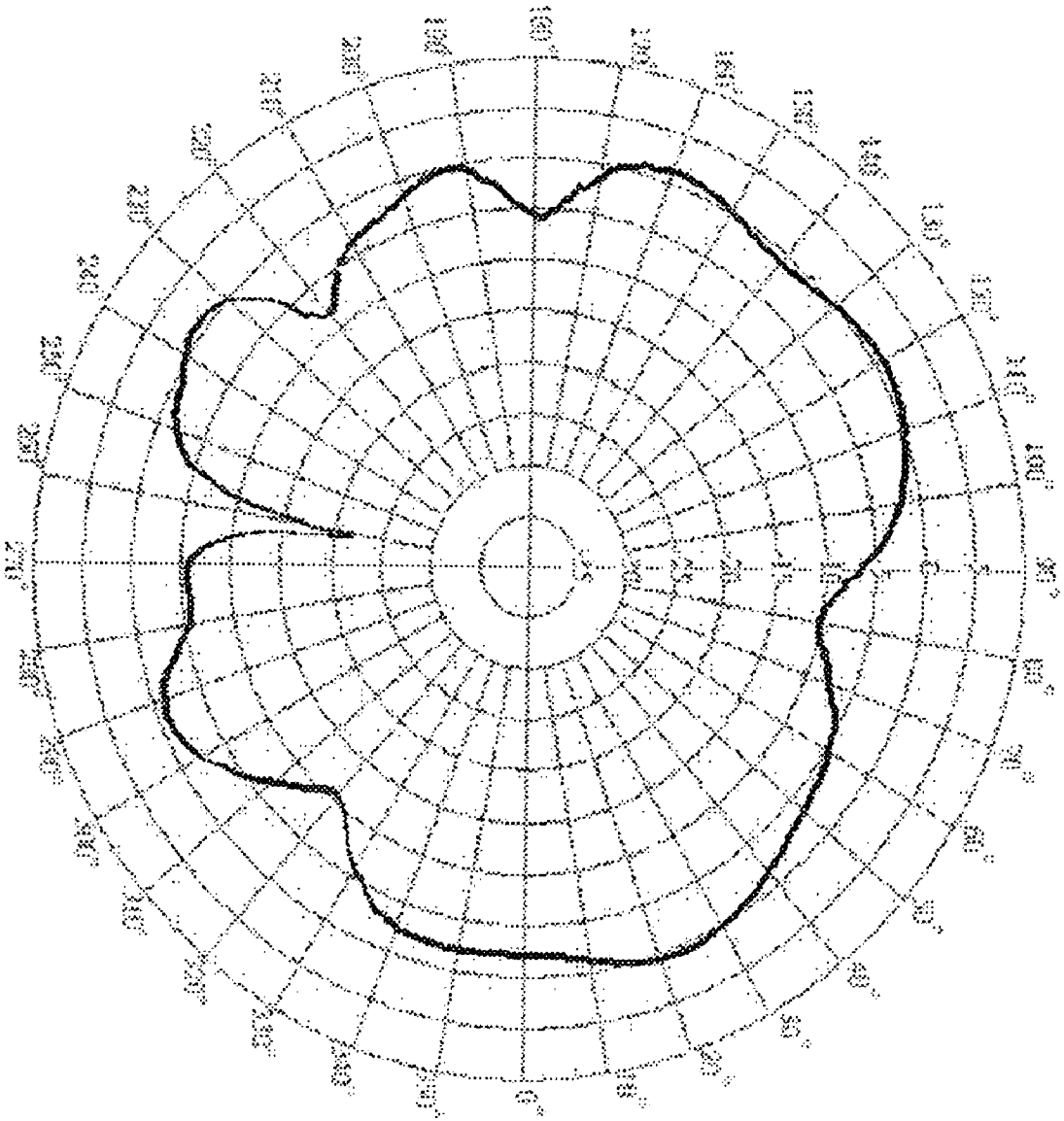
FIG. 5 is the radiation pattern in a resonant frequency of 2.5 GHz according to the present invention.

Referring to FIG. 3-5, there are shown radiation pattern of the antenna in accordance with the embodiment of the present invention in a resonant frequency of 2.4, 2.45 and 2.5 GHz, respectively. FIG. 4 shows H plane radiation pattern and the gain is around 1.64 dBi at 156 degree. FIG. 5 shows H plane radiation pattern. The gain is around 1.04 dBi at 158 degree. From a measurement result of a radiation pattern of an antenna designed and manufactured in the present invention using the rectangular and curved radiating element, it can be seen that a good radiation gain of more than 0 dBi can be obtained. The radiation pattern of the inventive antenna in accordance with the embodiment of the present invention has the considerably improved efficiency of reception.

From the foregoing, it shall be appreciated that specific embodiments of the invention have been described herein for purposes of illustration, but that various modifications may be made by those skilled in the art without deviating from the spirit and scope of the invention. Accordingly, the invention is not limited except as by the appended claims.

The invention claimed is:

1. An antenna structure comprising:

a ground plane;

a radiator having a curved shape portion and a rectangular portion connected to said ground plane via a first end of said curved shape portion and grounded by a ground point of said ground plane, said rectangular portion being connected to a second end of said curved shape portion; and a feed point connected to said second end of said curved shape portion of said radiator;

wherein said ground plane is located on the same plane of said radiator.

2. The antenna structure of claim 1, wherein said rectangular portion of said radiator is parallel to said ground plane.

3. The antenna structure of claim 1, wherein the thickness of said antenna structure is from 0.3 millimeter to 2 millimeters.

4. The antenna structure of claim 1, wherein the length of said rectangular portion of said radiator is about ¼ wavelength.

5. The antenna structure of claim 1, wherein the width of said rectangular portion of said radiator is from 1/20 to 1/50 wavelength.

6. The antenna structure of claim 1, wherein the radius of the outermost circle of said curved shape portion of said radiator is about 1/16 wavelength.

7. The antenna structure of claim 1, wherein the radius of the center hollow circle of said curved shape portion of said radiator is about 1/16 wavelength subtracting the width of said rectangular portion of said radiator.

8. The antenna structure of claim 1, wherein the height of said antenna structure is greater than or equal to the sum of the width of said rectangular portion of said radiator and the radius of the center hollow circle of said curved shape portion of said radiator.

9. The antenna structure of claim 1, wherein the length from the open end of said rectangular portion to the center of said curved shape portion of said radiator is greater than the sum of the length of said rectangular portion and the radius of the center hollow circle of said curved shape portion of said radiator.

10. The antenna structure of claim 1, wherein the total length of said antenna structure is greater than the sum of the length of said rectangular portion and the radius of the outermost circle of said curved shape portion of said radiator.

* * * * *